US007003815B2

(12) United States Patent
Herbst

(10) Patent No.: US 7,003,815 B2
(45) Date of Patent: Feb. 28, 2006

(54) FOOT OPERATED FLUSHING APPARATUS AND METHOD

(75) Inventor: Eric Herbst, North Haven, CT (US)

(73) Assignee: Foot Flush International, Inc., North Haven, CT (US)

( * ) Notice: Subject to any disclaimer, the term of this patent is extended or adjusted under 35 U.S.C. 154(b) by 3 days.

(21) Appl. No.: 10/773,630

(22) Filed: Feb. 6, 2004

(65) Prior Publication Data

US 2005/0172389 A1 Aug. 11, 2005

(51) Int. Cl.
*A47K 13/10* (2006.01)

(52) U.S. Cl. ..... 4/246.2; 4/246.1

(58) Field of Classification Search ..... 4/249, 4/246.1, 405, 411, 412
See application file for complete search history.

(56) References Cited

U.S. PATENT DOCUMENTS

| | | | | |
|---|---|---|---|---|
| 1,589,353 A | | 6/1926 | Bock et al. | |
| 1,614,346 A | * | 1/1927 | Coret | 4/249 |
| 1,615,523 A | | 1/1927 | Shimo | |
| 3,594,828 A | | 7/1971 | Seek | |
| 3,594,829 A | | 7/1971 | Seek | |
| 4,007,499 A | | 2/1977 | Lin | |
| 4,847,924 A | | 7/1989 | Samaniego | |
| 4,975,988 A | * | 12/1990 | Won | 4/246.3 |
| 5,068,925 A | | 12/1991 | Salibi | |
| 5,142,708 A | | 9/1992 | Johnson et al. | |
| 5,170,513 A | | 12/1992 | Ambooken et al. | |
| 5,289,593 A | * | 3/1994 | Lawrence | 4/246.1 |
| 5,339,468 A | | 8/1994 | Lin | |
| 6,089,542 A | | 7/2000 | Caravella et al. | |
| 6,651,262 B1 | | 11/2003 | Tinsley | |

* cited by examiner

*Primary Examiner*—Charles E. Phillips
(74) *Attorney, Agent, or Firm*—DeLio & Peterson, LLC; Kelly M. Nowak

(57) ABSTRACT

An apparatus and method for foot actuating a toilet by providing a foot pedal having an enhoused cable extending therefrom. The cable is attached inside the toilet tank to a flushing means within the tank. Upon a user stepping down on the pedal, dual components of the pedal provide for the amount of cable within the foot pedal to be increased by a factor of two relative to the pedal travel distance. This in turn provides for the cable inside of the tank to be decreased by such amount for lifting a weight and actuating the internal flushing means within the toilet tank. Upon removing the user's foot from the foot pedal, the foot pedal, cable and weight are automatically reset to a starting position allowing the toilet to be reset to its original position for reuse.

24 Claims, 5 Drawing Sheets

FOOT OPERATED FLUSHING APPARATUS AND METHOD

BACKGROUND OF THE INVENTION

1. Field of the Invention

The present invention relates to a foot operated apparatus, and in particular, to a foot operated flushing apparatus connected to an internal flushing means within a tank of a toilet such that the toilet is converted to a dual-actuated flushing toilet.

2. Description of Related Art

Conventional cistern type toilets typically include a seat, bowl, tank and hand actuated flushing mechanism such as a lever or handle at the front of the toilet tank for flushing the toilet. Once it is desirable to flush the toilet, a user of the toilet must actuate the lever by hand, whereby an internal component or system within the tank is activated for flushing the toilet. However, the use of hand operated toilets often leads to the spread of germs, disease and contaminants. They can also be difficult to operate for those with back problems, as well as being difficult to operate for the elderly due to the risk of falling or loosing ones balance as a result of extending and/or bending to hand-actuate the toilet lever.

To avoid the above problems, prior art has been directed to providing toilets with foot operated flushing apparatus. However, conventional foot operated flushing apparatus are often expensive and difficult to install, such as, those apparatus that entirely replace the lever or handle of the toilet with the foot operated flushing mechanism. For example, the prior art apparatus of Seek, U.S. Pat. Nos. 3,594,828 and 3,594,829, both replace a conventional flush handle/lever, as referred to therein respectively, with a cable connected to a foot-operated pedal or a hydraulically operated transmission tube connected to a foot-operated pedal for flushing the toilet.

Other conventional foot operated flushing apparatus are cumbersome and make it difficult to flush the toilet using the lever or handle. These include foot operated apparatus that are attached to the toilet lever for actuation thereof by adding on a foot operated flushing mechanism to the front of the toilet, and in particular, to the flushing lever or handle at the front of the toilet tank. The prior art is replete with such references. For instance, U.S. Pat. No. 4,847,924 to Samaniego discloses a toilet flushing mechanism comprised of a member that is disposed over the flush handle and is brought into engagement therewith by operation of a foot pedal. U.S. Pat. No. 4,868,931 to Schneeweiss includes a bracket assembly that is secured to the flush valve handle and is operatively connected to a foot lever. The apparatus described in U.S. Pat. No. 5,142,708 to Johnson et al. includes a flushing handle of a toilet being connected to a foot lever by a chain linkage. A number of other references, such as U.S. Pat. Nos. 4,847,924; 4,007,499; 5,170,513 and 5,339,468, focus on flushing control mechanisms connected to a lever or handle of a toilet or urinal for flushing thereof U.S. Pat. No. 6,089,542 to Caravella et al. discloses a foot-pedal connected by a cable to an integrated drive bar disposed to engage a plunger to affect actuation of a flushing element.

Again, these and other arrangements taught in the art typically suffer from one or more significant disadvantages. In particular, they are often expensive, difficult and time consuming to install, unattractive, inconvenient to use, hard to clean, cumbersome and subject to tampering, vandalism, or undue maintenance requirements.

As it is highly desirable to have a flushing control apparatus that eliminates the above problems, and one that is inexpensive, attractive, and both easily and conveniently installed on an existing toilet, a need continues to exist in the art for further improved methods and systems that assist in the flushing of a toilet that avoid spread of germs, disease and contaminants, and are easy to use.

SUMMARY OF THE INVENTION

Bearing in mind the deficiencies of the prior art, it is an object of the present invention to provide a flushing control system and method that are inexpensive, attractive, easily and conveniently installed on an existing toilet, and which operate in an easy, efficient and economical manner.

Another object of the present invention is to provide a foot operated flushing system and method that transforms an existing toilet, particularly a cistern type toilet, to a dual operated toilet.

It is another object of the present invention to provide a foot operated flushing system and method that significantly reduces hand-spread germs, disease and contaminants.

Still another object of the invention is to provide a foot operated flushing system and method that is easy to use such that it assists and reduces the risk of injury to both users with back problems and the elderly.

Another object of the present invention is to provide a foot operated flushing system that is easy and economically efficient to manufacture.

A further object of the present invention is to provide a foot operated flushing system in kit form that can be easily installed.

Yet another object of the present invention is to provide a foot operated flushing system and method that can be integrally formed with formation of a toilet such that the toilet can be dual operated either by hand or by foot.

Still other objects and advantages of the invention will in part be obvious and will in part be apparent from the following specification.

The above and other objects, which will be apparent to those skilled in art, are achieved in the present invention, which is directed to in a first aspect, a foot actuated toilet flushing apparatus that includes a foot operated pedal having a top plate pivotably attached to a base plate. A first roller is attached to the top plate while a second roller is attached to the base plate. The apparatus also includes a tank clamp positioned on a backside edge of a tank of a toilet and extending into an interior of the tank. This cable is preferably encased within a cable housing for protecting the cable. The cable is strategically positioned such that it extends from the base plate, over the first roller of the top plate, over and around the second roller of the base plate. The cable traverses through at least one opening of the base plate so as to contact and extend into the cable housing and then the cable housing with the cable therein exits the base plate. The cable housing then extends and travels adjacent the toilet and up the backside of the toilet and into the toilet tank. The tank clamp holds the cable housing, and as such the cable therein, in position in the interior of the tank. The cable exits the cable housing within the interior of the tank and connects to an internal release means within the tank. Upon applied foot actuated pressure to the top plate, a length of the cable is increased within the foot operated pedal and decreased by the length within the interior of the tank to activate the internal release means and effect flushing of the toilet.

In another aspect, the invention is directed to a foot actuated pedal that includes a base plate having at least one opening. The pedal also includes a top plate pivotably attached to the base plate, a first roller attached to the top plate and a second roller attached to the base plate. The pedal includes a cable that has a first end and a second end. The first end of the cable is affixed to a position on the base plate internal to the pedal while the second end of the cable is affixed to a component of a device external to the pedal. In the present foot pedal, the cable extends at the first end from the position on the base plate, over the first roller of the top plate, around the second roller of the base plate and extends out the at least one opening of the base plate. In so doing, the cable extends into and is encased by a cable housing. The cable is connected at the second end to the component of the external device, such that, upon applying pressure by foot to the top plate of the pedal, a length of the cable is increased within the pedal and decreased by the length external to the pedal to effect a working condition of the device. This device may include a variety of remotely operated devices such as those normally found in a bathroom including, but not limited to, a hand drier, a towel dispenser, a soap dispenser, a sink, tub or shower, lights, to unlatch a door, to open a door and the like.

In still another aspect of the invention is a method for foot actuated flushing of a toilet. The method includes providing a top plate of the pedal and attaching a first roller to the top plate. A base plate is also provided and a second roller is attached thereto. The top plate is then pivotably attached on top of the base plate. A toilet having a tank with an internal release means for flushing the toilet is provided, whereby a tank clamp is positioned on a backside edge of the tank such that a portion of the tank clamp extends into the tank. A cable is then positioned extending a first end of the cable from the base plate, over the first roller of the top plate, around the second roller of the base plate, extending out at least one opening of the base plate and into an interior of the tank at a backside of the toilet. The cable is held in place therein by the tank clamp. The second end of the cable is connected within the tank to the internal release means. Upon applying pressure by foot to the top plate, such top plate pivots, with respect to the base plate, to increase a distance between the first and second rollers and thereby increase a length of the cable within the pedal while simultaneously decreasing an amount of cable within the tank by the length to activate the internal release means and effect flushing of the toilet.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

The following description is provided to enable a person skilled in the art to use the invention and sets for the best modes for carrying out the invention. Various modifications will remain readily apparent to those skilled in the art.

The present invention is directed to a foot flushing apparatus, system and method for enabling easy, sanitary and adequate flushing of a toilet. It is configured to be attached to a variety of differing types of existing toilets such that the handle, lever, flush button and the like, which are often located at the front, side or top of the toilet tank, remain intact. The invention transforms existing toilets to ones that are dual-actuated flushable by providing a foot flushing apparatus that is attached through the back of the tank. In so doing, the foot flushing apparatus is attached through the back of the tank, either under the lid or through a hole in the tank, into the tank, and is then connected to the flushing means of such toilet located inside the toilet tank. Upon a user actuating the flushing apparatus by foot, components of the present foot flushing apparatus located inside the toilet tank are activated for flushing the toilet.

The invention will be better understood in accordance with the below description which makes reference to FIGS. 1A–5B.

Figure 1A:
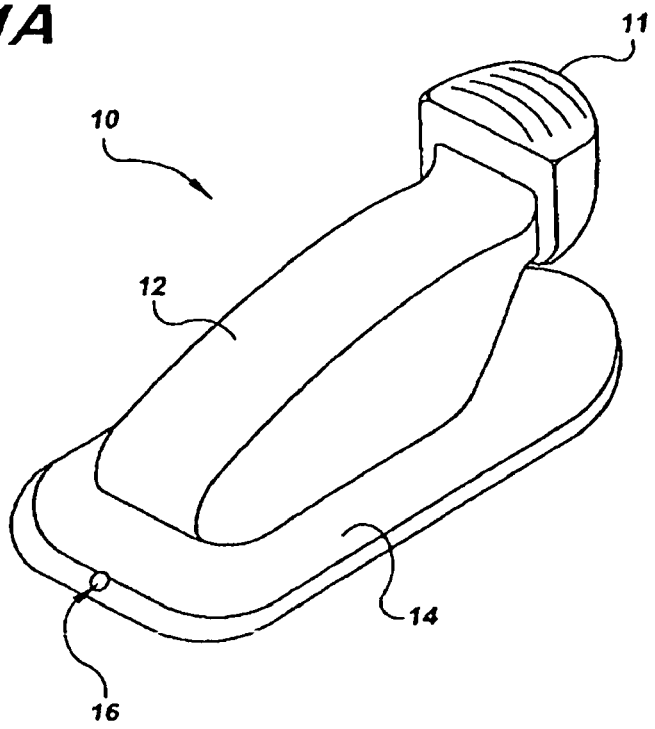
FIG. 1A is a front elevational view of a foot pedal of the present foot operated flushing apparatus according to one embodiment of the invention.
Figure 1B:
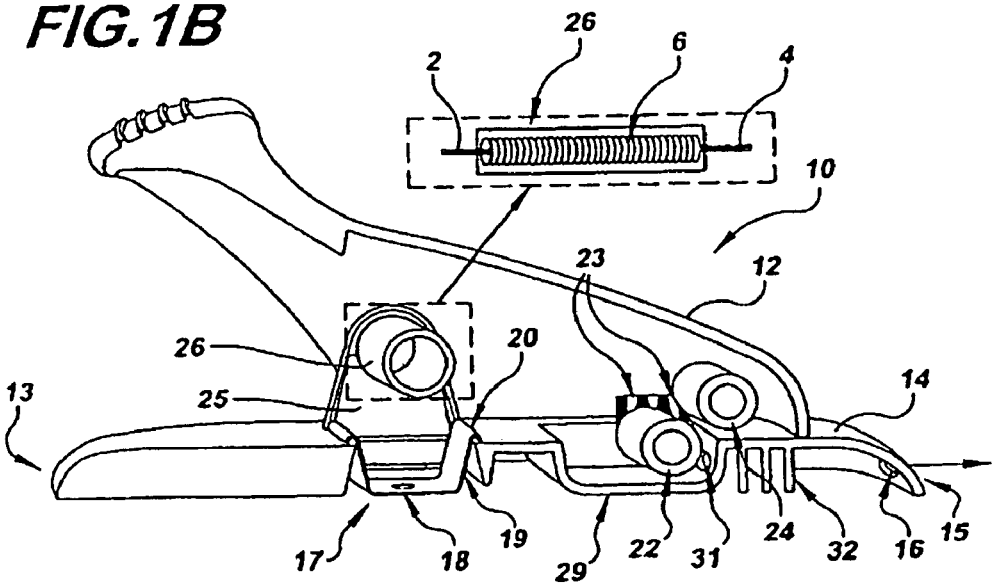
FIG. 1B is a side perspective view of the foot pedal shown in FIG. 1A.

Referring to the drawings, the present foot flushing apparatus includes a foot pedal 10. As shown in FIG. 1A, foot pedal 10 includes a pedal lever or top plate 12 attached to a base plate 14, whereby the base plate has an opening 16 at a frontal portion thereof. Both the top plate and the base plate may be formed of a variety of shapes including, but not limited to, circular, oval, square, rectangular, and the like, as well as having differing design shapes that are esthetically appeasing.

The foot pedal is positioned on the floor, desirably in a location that is in close proximity to a toilet for attaching various other components of the invention to such toilet. In so doing, referring to FIG. 1B, the base plate 14 may further include an opening 17 located substantially toward the center of the base plate for receiving a mounting bracket 18 to secure the base plate 14 to the floor. The mounting bracket is preferably of a rigid structure having sidewalls 19 and flanges 20 at a top of the sidewalls for clamping the mounting bracket 18 to the base plate 14 of the foot pedal. This mounting bracket may be a stainless steel spring clamp that can be attached to the floor by nuts, bolts, screws, and the like. Once this mounting bracket is secured to the floor, it may then be attached to base plate 14 of foot pedal 10 by applying a downward force to the pedal so that it snaps onto the mounting bracket. For example, wherein the mounting bracket 18 is a spring clamp, as downward pressure is applied to the pedal the clamp springs inward via the angled sidewalls 19 of opening 17 and then springs out once the top flange 20 is at a location past such sidewalls to secure the foot pedal to the mounting bracket.

Alternatively, the foot pedal 10 may be attached or secured to the floor by a variety of means. For instance, rather than using mounting bracket 18, the foot pedal may be secured to the floor using a removable, non-invasive means including, but not limited to, an adhesive, glue, cement, paste, epoxy resin, bonding agent, double-sided tape, velcro, suction, a non-slip rubber backing and the like. The removable, non-invasive means is preferably applied to the bottom surface of the base plate 14 for securing the foot pedal to the floor. In so doing, this removable, non-invasive means may be applied to the entire bottom surface area, a perimeter of the base plate, a flat bottom portion 29 of the base plate or even within opening 17. The foot pedal 10 may also be positioned on the floor using a non-slip mat, such as a non-slip rubber mat, positioned between the floor and the foot pedal 10 for retaining the foot pedal in a desired location or position.

The use of a removable, non-invasive means for attaching the foot pedal to the floor is advantageous as it does not require invasive drilling into a floor, such as a tile floor. Such removable, non-invasive means are also economically efficient, easy to install, and easy to remove, such as for the removal or detachment of the foot pedal from the floor for cleaning thereof.

In accordance with the invention, foot pedal 10 also includes a base roller 22 secured to base plate 14 and a pedal roller secured to the top plate or pedal lever 12. The base roller 22 has a rigid cylindrical structure with a hollow center wherein resides a spring. In contact with the spring, at opposing sides thereof, are a first pin and a second pin for positioning and securing base roller 22 into the base plate 14. The pins on opposing sides of the spring are pressed in a direction outward from the center of the spring and roller such that the pins are received respectively into a first and second receiving means 23, such as slots or openings, on opposing sidewalls of the base plate 14. The receiving means 23 may include a sloped ramp for receiving and guiding the pins into a secure position.

Top plate 12 (the pedal lever) also includes a pedal roller 24. Like base roller 22, pedal roller 24 is preferably rigid and cylindrical in shape having a hollow center wherein resides a second spring. In contact with this spring, at opposing sides thereof, are a second set of first and second pins for positioning and securing the pedal roller 24 into the top plate. Again, these pins are located at opposing sides of the spring and are pressed in a direction outward from the center of both the spring and the pedal roller such that these pins are received respectively into another set of first and second receiving means 23 on opposing sidewalls of the top plate 12. These receiving means 23 also preferably include a sloped ramp for receiving and guiding the pins into a secure position on the top plate.

The base plate 14 also includes side portions having an upward side flange 25, preferably two upward side flanges 25 at opposing sides of the base plate. The side flange 25 is positioned at a location that is closer toward the back end 13 of the base pedal 14, as compared to its location with respect to the front of the base pedal. This positioning of the side flanges 25 is advantageous as it provides leverage to the top plate 12 during actuation mode to maximize cable pull as is discussed further below.

A pivot point is positioned between side flanges 25 of the base plate 14, preferably at a top portion thereof, for attaching the top plate to the base plate. The pivot point also enables pivoting of the top plate with respect to the bottom plate for effecting flushing of a toilet in accordance with the invention. This pivot point may be a pivot cylinder 26 that has a hollow center wherein resides a spring 6 with a first pin 2 and second pin 4, as shown within the dashed line exploded view of FIG. 1B, in contact with the spring on opposing sides thereof This spring 6, and the pins 2, 4 of the pivot cylinder 26 are similar to those described above with respect to the base roller 22 and the pedal roller 24. However, it should be appreciated that various other pivoting means may be used to attach the top and bottom plates together and allow for pivoting of the top plate.

Preferably, the base plate 14 is attached to the top plate 12 via the pivot cylinder 26 with spring and first and second pins extending therefrom. In so doing, the top plate 12 has on opposing sidewalls thereof receiving means (not shown), such as receiving means 23 described above. The receiving means of the top plate are positioned at a sufficient height and location on the top plate such that when the top plate is attached to the bottom plate, a bottom surface of the top plate makes contact with a top surface of the bottom plate. That is, these receiving means are located on sidewalls of the top plate in locations corresponding to where the pivot cylinder 26 pins will be located upon mounting the top plate to the base plate to allow for flushing of a toilet to which the foot pedal is attached, as discussed further below. In attaching the top plate to the base plate, the top plate is positioned over the bottom plate whereby the receiving means is aligned to the first and second pins extending outwardly from the pivot cylinder. Upon applying pressure to the plates for attachment thereof, the pins are received into the receiving means of the top plate and are guided into a secured, locked position via the sloped ramp of the receiving means. The bottom and top plates are then attached to each other in alignment. Upon actuation of the foot pedal 10 by a user, the top plate 12 is depressed downward such that the top plate pivots with respect to the bottom plate via the pins extending from pivot cylinder 26.

Figure 2A:
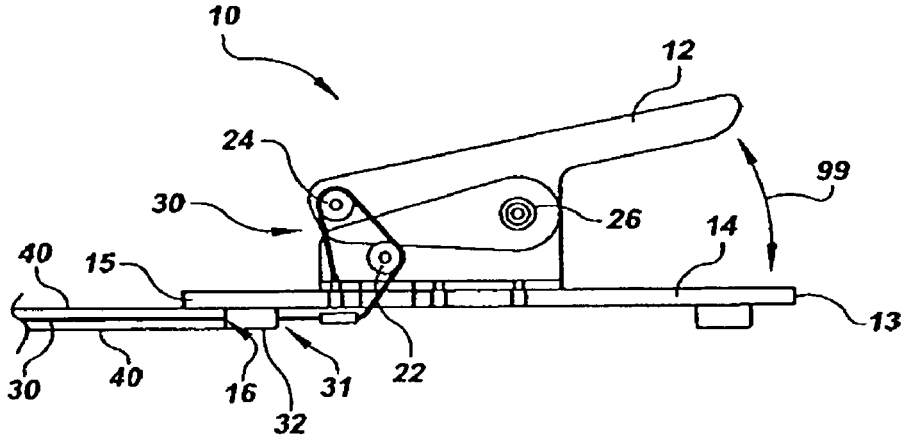
FIG. 2A is a side view of a foot pedal of the present foot operated flushing apparatus in a standard, non-actuated position.
Figure 2B:
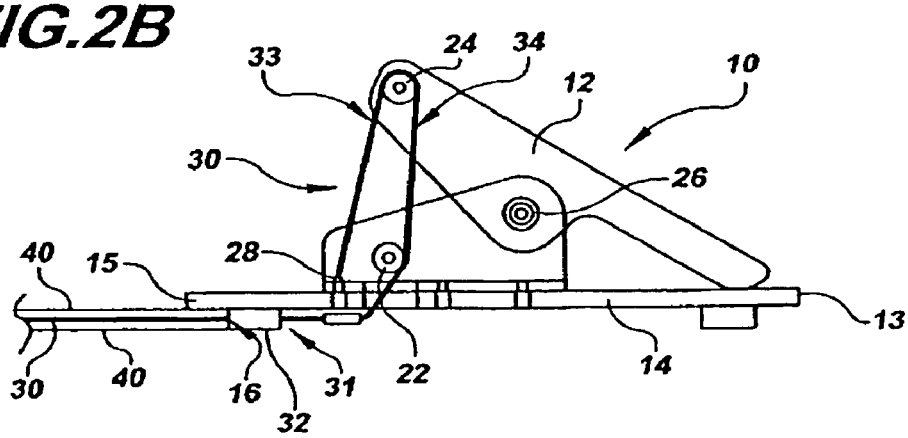
FIG. 2B is a side view of the foot pedal of FIG. 2A showing the foot pedal actuated in accordance with the invention.

Referring to FIGS. 2A–3B, crucial components of the present foot operated flushing apparatus include cable 30, cable housing 40, tank clamp 50 and weight 60. As shown in FIGS. 2A–B, cable 30 is strategically positioned within the foot pedal for foot actuated flushing in accordance with the invention. The cable 30 comprises a water impermeable material of sufficient strength and durability to endure pressures applied during repeated foot actuated flushing in accordance with the invention, such that the cable does not break, fray, stretch, expand, deteriorate and the like. Preferably, cable 30 comprises a polysilicon, nylon or polyester blend wire, cord or rope. However, it will be appreciated that any known wiring, cord, or rope material of sufficient strength, flexibility and durability may be used. The cable is enclosed by a cable housing 40 for protecting cable 30 during use as well as from tampering. The cable housing 40 preferably comprises a nylon lined, metal encased cable housing that is preferably wrapped in plastic.

The cable 30 component of the invention is strategically positioned within the foot pedal 10. Referring to FIGS. 1B–2B, the cable 30 is secured to base plate 14 at a location 28 at a front end 15 of the base plate 14. Cable 30 extends upward from the base plate and then sequentially over pedal roller 24, around and under base roller 22 and out opening 31 of the base plate 14. The cable is received by cable housing 40 at opening 31 for protecting the cable 30. The cable housing 40 is preferably secured to the base plate 14 at the location of opening 31. The cable housing 40, enhousing cable 30, runs through and is held in place via securing means 32 and out opening 16 at the front end 15 of base plate 14 (which preferably faces the toilet tank). These securing means 32 may comprise a plurality of ribs whereby upon inserting the cable housing into such ribs, the ribs pinch the cable housing 40, without damaging or causing any stresses to cable 30 therein, such that the cable housing is secured in place within the base plate of the foot pedal. The cable housing then exits the base plate at opening 16, which is located at the front end 15 of the base plate.

As described above, the positioning of cable 30 wraps over and around pedal roller 24 and base roller 22 once, however, it should be appreciated that the cable may wrap over and around pedal and base rollers two or more times. For example, cable 30 may extend from position 28, up and over pedal roller 24, around and under base roller 22, again up and over pedal roller 24, again around and under base roller 22, and then out opening 16. This positioning of cable 30 over and around base and pedal rollers may be repeated as many times as desired while still maintaining functionality of the present foot pedal.

Figure 3A:
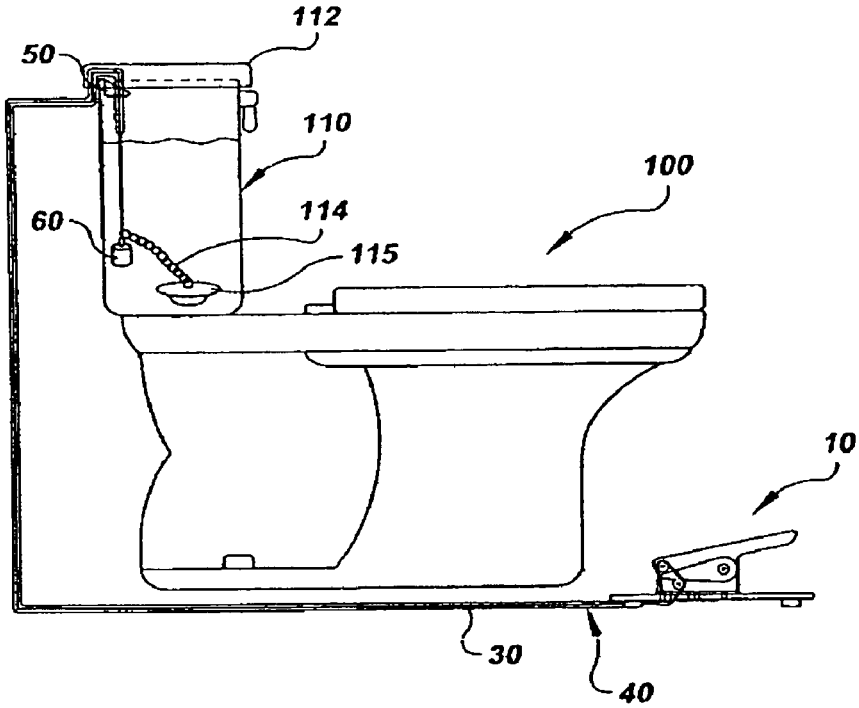
FIG. 3A is a side view showing the foot operated flushing apparatus of the invention attached to the water release flushing means within a toilet tank in the non-actuated mode wherein the pedal is integrally formed with the toilet such that the cable housing and cable are invisible to the naked eye.
Figure 3B:
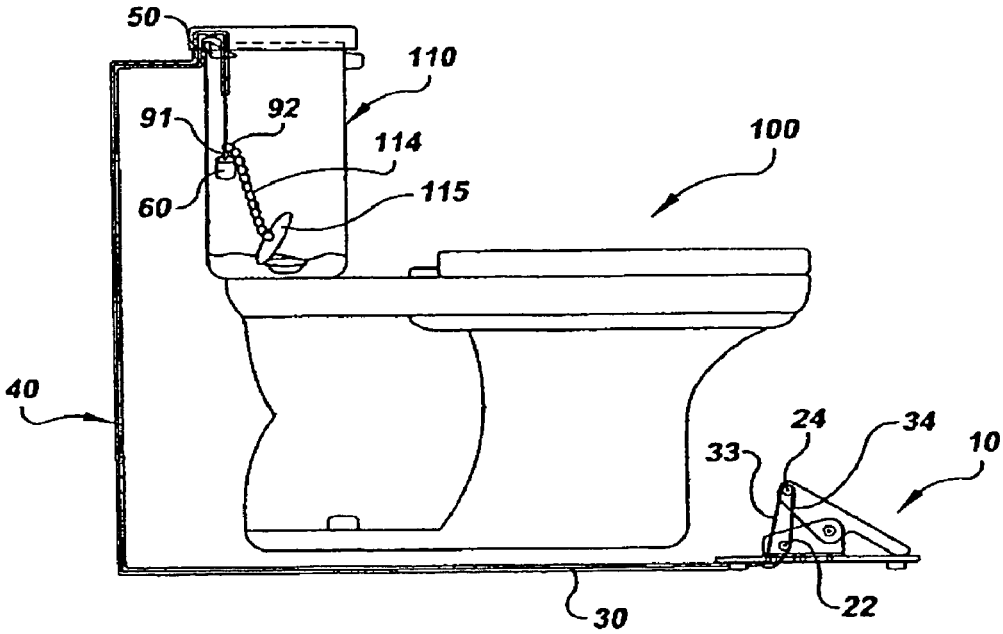
FIG. 3B is a side view showing the foot operated flushing apparatus of the invention attached to the water release flushing means within a toilet tank in the actuated mode in accordance with FIG. 2B for flushing the toilet.

Referring to FIGS. 3A–B, cable 30 enhoused by cable housing 40 both extend from the front of the foot pedal toward the tank 110 of a toilet 100. In so doing, cable 30 and housing 40 may run along the floor adjacent the toilet and up the back of the toilet such that a user of the present foot flushing apparatus minimally views housing 40 with cable 30 therein. Alternatively, the foot pedal and cable housing may be formed as a component of toilet 100, such as being integrally molded or cast with the toilet as-formed. In this aspect, the cable housing and cable 30 therein would both be invisible to the naked eye.

Referring to FIGS. 3A–4B, wherein the cable housing 40 and cable 30 run upward along a back perimeter of the toilet, an essential feature of the invention is a tank clamp 50 positioned at a backside of tank 110 under lid 112 of toilet tank. The tank clamp holds and secures the cable housing 40 with cable 30 therein inside the toilet tank. Tank clamp 50 is preferably fabricated from a rigid material, such as stainless steel or any other known durable non-rusting material, in order to provide the tank clamp with sufficient strength and durability to be held in place to the toilet tank and withstand any forces applied during flushing operations in accordance with the invention.

The tank clamp 50 is a crucial component of the invention and has a number of advantages. It is easily and quickly self-affixed to the toilet tank. The tank clamp is of minimal thickness such that it does not interfere with the toilet lid 112 because it adds a negligible, insufficient amount of height to the toilet tank. It also prevents the cable 30 and the weight 60 from contacting or hitting the sidewalls of the interior of tank 110, as well as directs the cable 30 toward the internal flushing mechanism within the toilet tank.

Figure 4A:
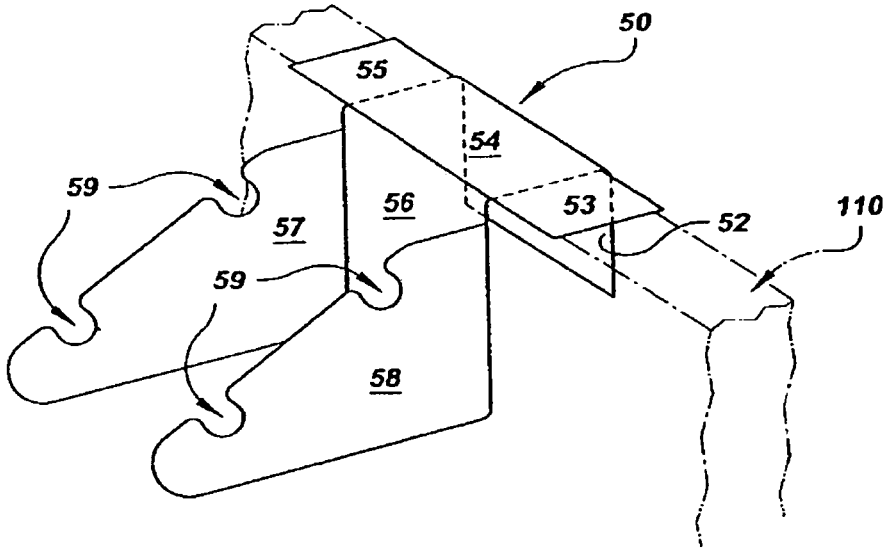
FIG. 4A is a side perspective view of the tank clamp of the foot operated flushing apparatus of the invention.
Figure 4B:
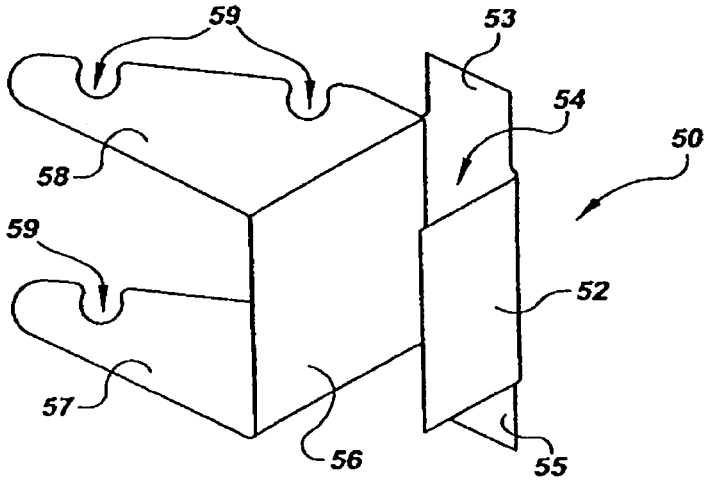
FIG. 4B is an alternate side perspective view of the tank clamp of FIG. 4A.

FIGS. 4A–B show a preferred embodiment of tank clamp 50 having a back flange 52 connected to a front flange 56 via an upper flange 54. These flanges 52, 56 and 54 position and hold the tank clamp to the back of tank 110, as well as assist in stabilizing the tank clamp to tank 110. The upper flange 54 further includes opposing extensions thereof, e.g., a first lateral extension 53 and a second lateral extension 55 to enhance securing or stabilizing the tank clamp 50 to the toilet. These opposing lateral extensions 53 and 55 also prevent rocking of the clamp 50 once it is positioned on the tank 110 and assist in distributing forces applied to the tank clamp 50 during foot flushing in accordance with the invention. Further, upon positioning the tank clamp 50 to toilet tank 110, the back flange 52 resides on the exterior of the tank 110 while the front flange 56 resides on the interior of such tank.

Figure 5A:
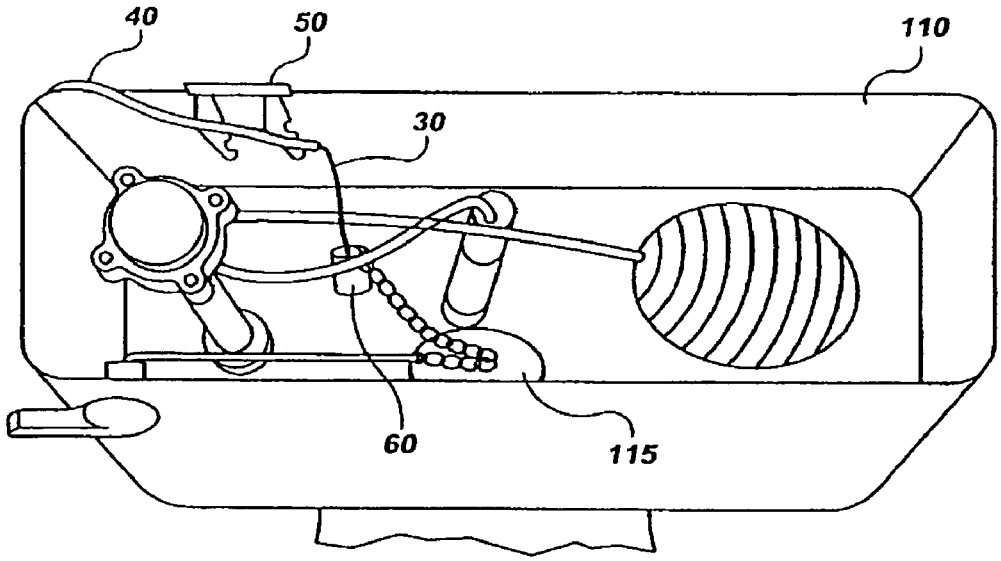
FIG. 5A is a top perspective view of the present invention attached to a flapper water release flushing means within a toilet tank.

Extending from front flange 56 within the tank 110 are two outwardly protruding cable support flanges 58, 57. In preferred embodiment, each outwardly protruding cable support flanges 58, 57 has an angled top portion that extends into the toilet tank, whereby each angled top portion has at least two recessed portions 59. The recessed portions 59 of side flange 57 are aligned with recessed portions 59 of side flange 58 such that they are adapted to receive, hold and secure in place cable housing 40. The cable housing 40 and the cable 30 therein may be received at an angle by being secured in place at a top recessed portion of a first of the side flanges and then at a bottom recessed portion of the second, opposing side flange as shown in FIG. 5A.

Figure 5B:
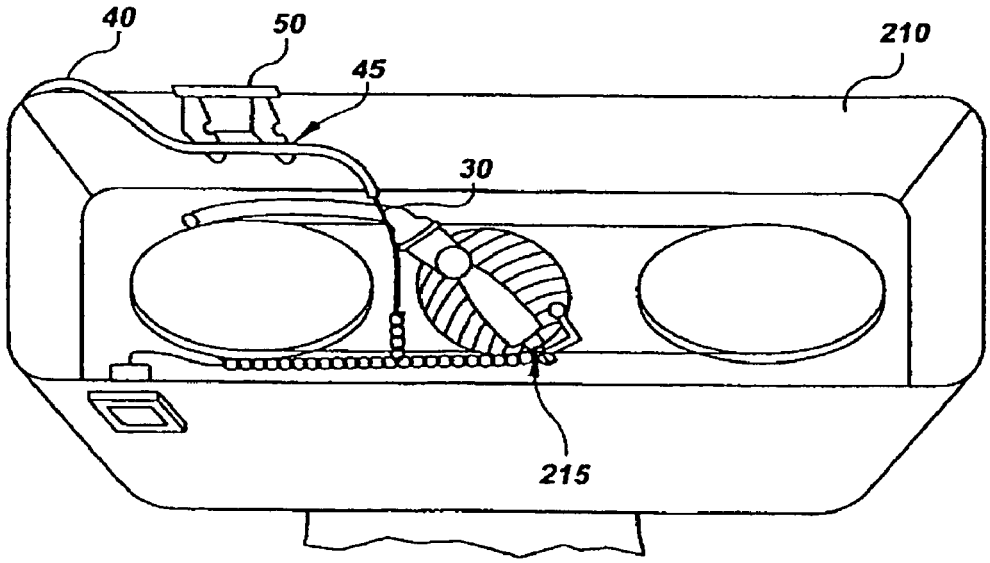
FIG. 5B is a top perspective view of the present invention attached to a pressure operated water release flushing means within a toilet tank.

Alternatively, the cable 30 may be received straight across the bottom or top recessed portions of both the first and second flanges 57, 58 as shown in FIG. 5B. In so doing, a guiding means 45, preferably having at least one curved end, may be used to position the cable 30, extending from such guiding means 45, away from the sidewalls of the toilet tank. The cable housing 40 extends into the interior of the toilet tank, such as through a hole in the backside of the tank, and directly connects to or is attached to the guiding means. In so doing, only the cable 30 extends through the guiding means 45 straight across either the bottom or top recessed portions of the first and second flanges 57, 58. The cable 30 exits the guiding means, such as at the curved end, so as not to contact the sidewalls of the tank. This guiding means 45 may be a pipe or tubing of a non-rusting material, such as stainless steel with an interior nylon lining, that is of sufficient strength, thickness and durability to withstand forces applied from use in accordance with the invention.

Referring again to FIGS. 3A–B, the cable housing 40 clips onto base plate 14 of the foot pedal and surrounds cable 30. The combined cable housing 40 and cable 30 proceeds along the backside of the toilet 100, is directed under tank lid 112, into tank 110 and held in position in the tank by tank clamp 50. The cable housing portion within tank 110 stops at an upper portion of the tank, preferably above the water in tank 110. In securing the cable housing, and hence cable 30, into tank 110, it is preferably snapped and locked in position, either at an angle or straight as discussed above, within a first recessed portion 59 on side flange 57 and a second recessed portion 59 on side flange 58.

Once in place, cable 30 preferably extends into the tank 110, past the second end of the cable housing. Optionally, at this second end of cable 30, within tank 110, is positioned and secured a weight 60 via a first attachment device 91. Preferably, weight 60 is a stainless steel weight of about 4 ounces to about 16 ounces, preferably from about 8 to 12 ounces. However, it should be appreciated that weight 60 may comprise a variety of differing materials and weight measurements dependent upon its use within a variety of different toilet tanks. Weight 60 is preferably either cylindrical or round in shape, or alternatively, any other shape that allows the weight 60 to rotate or spin easily such that any twisting of chain 114 or entangling of the weight with the chain 114 is avoided.

Referring to FIGS. 5A-B, the positioning of the cable housing 40 and cable 30 at an angle by the tank clamp prevents weight 60 from contacting sidewalls within the tank, and in particular, the inner back wall of tank 110, as well as directs the cable 30, and optional weight 60, toward the internal water release flushing means within the toilet tank, such as, a flapper 115 in gravity toilet tank 110, or a flush button of a pressurized tank 215 in a pressurized toilet tank 210.

Cable 30 is then connected to the water release flushing means within the toilet tank via a second attachment device 92. In the preferred embodiment, these attachments of the cable are preferably accomplished by use of at least two swivel hooks. The swivel hooks are attached to the second end of cable 30 residing in toilet tank 110. A first of such hooks, i.e., swivel hook 91, is attached to weight 60, whereby weight 60 has loop or hook portion for receiving swivel hook 91. The second swivel hook 92 connects the cable 30 to the water release flushing means within the toilet tank. This may be preferably accomplished by attaching swivel hook 92 to the chain attached to such flushing means, as shown in FIGS. 3A–B and 5A–B.

In operating the present foot actuated flushing apparatus and system a user may flush a toilet by stepping on the top plate 12 of the foot pedal 10, preferably on a heel 11 of the top plate 12, such that downward force is applied to the top plate. This downward force causes the top plate 12 (pedal lever) to pivot on the pins extending from pivot roller 26 such that the cable 30 within the foot pedal is moved from its rest position (non-flushing mode), as shown in FIG. 3A, to a fully actuated mode (flushing mode), as shown in FIG. 3B, for flushing the toilet 100.

In so doing, when the pedal is at rest, pedal roller 24 is positioned at a location above and adjacent to base roller 22. Upon applying downward pressure to the top plate, preferably the heel 11 of the top plate, the front end of the top plate 12 is raised, and as such, the pedal roller 24 is also raised to final full-actuation positions as shown in FIG. 3B. In this full actuation mode of the invention, cable 30 inside foot pedal 10 extends from location 28 upward and over pedal roller 24, which is now positioned at a location over base roller 22, or even over and behind the base roller 22. This in effect results in the length of cable 30 within the foot pedal 10 to be at least double multiplied therein, which in turn effects flushing of the toilet as discussed below. This in effect results in the length of cable 30 within the foot pedal 10 to be significantly increased, preferably by a factor of approximately two, or even slightly more or less, relative to the pedal travel distance upon full actuation mode, which in turn effects flushing of the toilet as discussed below.

That is, pedal roller 24 and base roller 22 are positioned in a block and tackle configuration such that the present foot actuated systems advantageously enables increasing the amount of cable 30 pulled into the foot pedal upon full actuation mode by a factor of about two relative to the pedal travel. In accordance with the invention, it should be appreciated that the amount of cable increased within the foot pedal is dependent upon the positioning of the pedal roller 24 with respect to the base roller 22 (either being directly above, above and behind, or above and forward) and/or on the number of times that the cable 30 is wrapped around pedal and base rollers in the block and tackle configuration.

For ease of understanding the foregoing, as shown in FIG. 2A, in the non-actuated mode, the foot pedal has a distance 99 from the top plate 12 to the bottom plate 14. Upon actuating and depressing the heel 11 of top plate 12 down to the base plate for the fully actuated mode (FIG. 2B), the distance that the cable 30 is increased within the foot pedal includes a first length 33 (which is at approximate to or greater than distance 99) and a second length 34 (which is at approximate to or greater than distance 99). As shown, this first length 33 extends from position 28 up to fully actuated-mode position of pedal roller 24, while a second length 34 of cable 30 extends from fully actuated pedal roller 24 down to base roller 22. For example, wherein the present pedal has a top plate 12 to base plate distance 99 of about 2.05 inches, the amount of cable 30 pulled into and increased with the foot pedal, upon full actuation mode (FIG. 2B), is a first length 33 of about 2 inches and a second length 34 of about 2 inches with the total increased cable pulled into the foot pedal being about 4 inches, i.e., the cable 30 pulled into the foot pedal upon full actuation mode is increased by a factor of approximately two relative to the pedal travel of about 2.25 inches.

In accordance with the invention, this increased cable 30 pull within the foot pedal for effecting flushing of the toilet is realized as a result of two components of the invention. The first component being the positioning of the base roller 22 and the pedal roller 24 enabling the at least double multiplication of the amount of cable pulled into the foot pedal. Wherein the pedal roller 24, in full actuation mode, resides above and directly over the base roller 22, the amount of cable increased within the foot pedal, relative to the pedal travel distance 99, will be increased by a factor of approximately two. However, wherein the pedal roller 24, in full actuation mode, resides above and behind the base roller 22, the amount of cable increased within the foot pedal, relative to the pedal travel distance 99, will be increased by a factor greater than about two since the amount of cable length 33 extending from position 28 up to fully actuated-mode position of pedal roller 24 will increase.

In accordance with the invention, this increased cable 30 pull within the foot pedal for effecting flushing of the toilet is realized as a result of two components of the invention. The first component being the positioning of the base roller 22 and the pedal roller 24 enabling the multiplication of the amount of cable pulled into the foot pedal relative to the movement 99. Wherein the pedal roller 24, in full actuation mode, resides above and directly over the base roller 22, the amount of cable increased within the foot pedal, relative to the pedal travel distance 99, will be increased by a factor of approximately two. However, wherein the pedal roller 24, in full actuation mode, resides above and behind the base roller 22, the amount of cable increased within the foot pedal, relative to the pedal travel distance 99, will be increased by a factor of about two since the amount of cable length 33 extending from position 28 up to fully actuated-mode position of pedal roller 24 will also increase.

As the cable length, in full actuation mode, is at least doubled within the foot pedal, this pull of the cable causes a decrease in the amount of cable length within the toilet tank. In achieving the full actuation mode of the invention, cable 30 is pulled through cable housing 40 to increase the length of cable in the pedal while decreasing the length of cable in the tank by such amount, which in turn, activates the water release means within the tank to affect flushing of the toilet. Referring to FIGS. 3A–B, the non-actuated mode of FIG. 3A shows the flushing water release means (e.g. flapper 115, pressurized tank 215, etc.) in a closed position such that the water remains in the tank.

However, in the full actuated mode of the invention, FIG. 3B shows that this decrease of cable 30 within the toilet tank causes the weight 60 to be lifted such that the flapper 115 is also lifted for releasing water from the tank to flush the toilet. When the user's foot is removed, the foot pedal 10 is instantaneously and automatically reset by retuning to its original, starting non-actuated position as shown in FIG. 3A. The internal flushing mechanism typically resets once the water is flushed from the tank. In resetting the foot pedal, the weight 60 retracts down to its original starting position within the tank. This is accomplished via gravity pulling the weight 60 down to retract the cable from the foot pedal, through the cable housing 40, and back into the toilet tank, thereby allowing the toilet and the present system to return back to their original positions, i.e., non-actuated or non-flushing mode. Also, the angled attachment of cable housing 40 within tank 110, via tank clamp 50, prevents the weight 60 from contacting any internal walls within the tank. Further, by clamping the cable housing 40 and cable 30 at an angle via tank clamp 50 within the toilet tank, flushing in accordance with the invention is enhanced as a result of the decreased angle at which cable 30 is connected to the internal water release flushing means. Once both the foot pedal 10 and the internal flushing mechanism have been reset and returned to the original non-actuated mode, the toilet tank refills with water for reuse in accordance with the invention.

Again, the present invention is for use in a variety of differing type toilets including, but not limited to, gravity tank toilets, pressurized tank toilets, and flush valve operated toilets. For purposes of the invention, gravity tank toilets are those toilets most commonly found in residential homes that depend on the volume of water in the tank to flush waste. Pressurized toilet tanks are those tanks that use water line pressure to achieve a higher flush velocity. In these systems, water is not stored inside the toilet tank itself, but rather, in an internal tank within the toilet tank that compresses a pocket of air and releases pressurized water into the toilet bowl and out the trapway at the bottom of such bowl. Both gravity and pressurized toilet tanks may have a variety of differing hand-actuated flushing mechanisms, such as, a handle, lever, push button, and the like. The invention is useful for transforming those toilets operated (flushed) by pushing a button into toilets that are dual-operated, i.e., by foot and by push button. The present apparatus may be in kit form for transforming an existing toilet into one that is dual-operated, i.e., the hand-actuated flushing means remains in its original form for flushing and a foot operated flushing apparatus is added onto the existing toilet.

The present pedal with the cable extending therefrom may also be used for foot actuated operation of flush valve toilets, such as those that not having a toilet tank, but rather a valve directly connected to the water supply plumbing out of a building, such as a urinal or those toilets commonly found in many public restrooms. In this aspect of the invention, the foot actuated system replaces the lever or handle of such toilets and with a dual activated handle and at least cable housing 40 and cable 30. In so doing, the cable housing 40 ends at a dual activated handle (not exterior sidewall) of such toilet, and the cable 30 extends into the dual activated handle (not internal) flushing system of the toilet whereby it is directly connected to the internal flush valve for actuating flushing in accordance with such flush valve operated toilets. It should also be appreciated that the foot operated pedal of the present invention is not limited to operating a toilet. It may be used to effect a working condition of a variety of remotely operated devices such as those found in a bath room including, but not limited to, a hand drier, a towel dispenser, a soap dispenser, a sink, tub or shower, lights, to unlatch a door, to open a door and the like.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A foot actuated toilet flushing apparatus comprising:

a pedal having a top plate pivotably attached to a base plate;

a first roller attached to said top plate and a second roller attached to said base plate, whereby said first and second rollers each comprise a hollow cylinder enhousing a spring and a set of pins on opposing sides of said spring, each of said pins being in contact with said spring at a first end and being secured in position at an opposing second end to receiving means on opposing sidewalls of each said top plate for said first roller and said base plate for said second roller;

a tank clamp positioned on a backside edge of a tank of a toilet having an internal release means and extending into an interior of said tank;

a cable residing in said pedal, extending out said base plate and into said interior of said tank at said backside of said toilet, whereby said cable is held in place by said tank clamp and connected to said internal release means within said tank; and a cable housing encasing at least a portion of said cable, whereby upon applying pressure to said top plate of said pedal, a length of said cable is increased within said pedal and decreased by said length within said interior of said tank to activate said internal release means and effect flushing of said toilet.

2. The apparatus of claim 1 wherein said top plate is pivotably attached to said base plate, said apparatus further comprising:

said base plate having a first and a second opposing upward extending flanges located at a position on said base plate for maximization of cable increase within said pedal;

a pivot roller positioned between said first and second opposing upward extending flanges;

a spring within said pivot roller;

a first pin and a second pin extending in said pivot roller and in contact with opposing ends of said spring, said first and second pins extending through said upward extending flanges to contact said top plate; and said top plate having a first receiving means and an opposing second receiving means for receiving and securing in position said first and second pins to pivotably attach said top plate to said base plate.

3. The apparatus of claim 2 wherein said pedal is mounted to a floor adjacent a toilet.

4. The apparatus of claim 3 wherein said pedal is mounted to said floor by a mounting means selected from the group consisting of a mounting bracket, a spring clamp, an adhesive, glue, cement, paste, epoxy resin, bonding agent, double-sided tape, hook and loop suction, and non-slip rubber.

5. The apparatus of claim 1 wherein said cable comprises an impermeable material of sufficient strength, flexibility and durability to endure pressures applied during use of said pedal.

6. A foot actuated toilet flushing apparatus comprising:

a pedal having a top plate pivotably attached to a base plate;

a first roller attached to said top plate;

a second roller attached to said base plate;

a tank clamp positioned on a backside edge of a tank of a toilet having an internal release means and extending into an interior of said tank;

a cable residing in said pedal, extending out said base plate and into said interior of said tank at said backside of said toilet, whereby said cable is held in place by said tank clamp and connected to said internal release means within said tank;

a cable housing encasing at least a portion of said cable; and at least two swivel hooks attached to an end of said cable residing in said interior of the tank, a first of said swivel hooks connecting said cable to a weight and a second of said swivel hooks connecting said cable to said internal release means within said tank, whereby upon applying pressure to said top plate of said pedal, a length of said cable is increased within said pedal and decreased by said length within said interior of said tank to activate said internal release means and effect flushing of said toilet.

7. The apparatus of claim 6 wherein said weight comprises a rust-proof material of about 4 ounces to about 16 ounces, and comprises a shape that prevents entanglement of said weight with interior components of said tank.

8. The apparatus of claim 6 wherein said tank clamp comprises a material of sufficient rigidity and strength to endure forces applied to said tank clamp during normal working operations of said pedal.

9. The apparatus of claim 8 wherein said tank clamp includes a back flange connected to a front flange via an upper flange that has lateral extensions on opposing sides thereof for stabilizing said tank clamp to said backside edge of said tank and distributing forces applied to said tank clamp during use of said pedal, said back flange is in contact with an exterior of said tank while said front flange is within and in contact with said interior of said tank.

10. The apparatus of claim 9 wherein said tank clamp further includes at least two outwardly protruding angled sidewall flanges extending from said front flange into said interior of said tank, said outwardly protruding angled sidewall flanges including at least one recessed portion for receiving said cable housing.

11. The apparatus of claim 10 wherein said at least one recessed portion receives and secures said cable housing within said interior of said tank such that said cable extends into said tank in a direction away from sidewalls of said tank and toward said internal release means within said tank.

12. The apparatus of claim 11 wherein an angled guide encasing a portion of said cable is received and secured across said at least one recessed portion of said tank clamp such that an angle of said angled guide extends into said tank to direct said cable in a direction away from sidewalls of said tank and toward said internal release means within said tank.

13. The apparatus of claim 6 wherein said toilet is selected from the group consisting of a gravity tank toilet, a pressurized tank toilet, and a flush valve operated toilet.

14. The apparatus of claim 13 wherein said internal release means comprises a flapper or a pressurized tank push valve.

15. A foot actuated toilet flushing apparatus comprising:

a base plate having at least one opening;

a top plate pivotably attached to said base plate; a first roller attached to said top plate having a hollow cylinder enhousing a first spring and a first set of pins on opposing sides of said first spring, each of said first set of pins being in contact with said first spring at a first end and being secured in position at an opposite end to opposing sidewalls of said top plate;

a second roller attached to said base plate having a hollow cylinder enhousing a second spring and a second set of pins on opposing sides of said second spring, each of said second set of pins being in contact with said second spring at a first end and being secured in position at an opposite end to opposing sidewalls of said base plate;

a cable;

a first end of said cable affixed to a position on said base plate internal to said pedal; and a second end of said cable affixed to a component of a device external to said pedal, whereby said cable extends at said first end from said position on said base plate, over said first roller of said top plate, around said second roller of said base plate, extending out said at least one opening of said base plate so as to extend into and be encased by a cable housing, and connecting at said second end to said component of said external device, such that, upon applied pressure to said top plate of said pedal, a length of said cable is increased within said pedal and decreased by said length external to said pedal to effect a working condition of said device.

16. The apparatus of claim 15 wherein said top plate is pivotably attached to said base plate, said apparatus further comprising:

said base plate having a first and a second opposing upward extending flanges located at a position on said base plate for maximization of cable increase within said pedal;

a pivot roller positioned between said first and second opposing upward extending flanges;

a spring within said pivot roller;

a third set of pins extending in said pivot roller and in contact with opposing ends of said spring, said third set of pins extending through said upward extending flanges to contact said top plate; and said top plate having receiving mechanisms for receiving and securing in position said third set of pins to pivotably attach said top plate to said base plate.

17. The apparatus of claim 15 wherein said pedal is mounted to a floor in a position in close proximity to said device.

18. The apparatus of claim 15 wherein said device external to said pedal is selected from the group consisting of a gravity tank toilet, a pressurized tank toilet, and a flush valve operated toilet.

19. The apparatus of claim 15 wherein said component of said device comprises a release mechanism selected from the group consisting of a flapper or a pressurized tank push valve.

20. A foot actuated toilet flushing apparatus comprising:

a pedal having a top plate pivotably attached to a base plate, said base plate including a first opening, securing ribs and a second opening;

a first roller attached to said top plate;

a second roller attached to said base plate;

a tank clamp positioned on a backside edge of a tank of a toilet having an internal release means and extending into an interior of said tank;

a cable housing encasing at least a portion of a cable; and said cable residing in said pedal, sequentially positioned extending from said base plate, over said first roller of said top plate, around said second roller of said base plate, extending out said first opening of said base plate so as to extend into and be encased by said cable housing, said cable housing being positioned and secured within said securing ribs of said base plate and exiting through said second opening of said base plate, said cable housing traveling adjacent said toilet and up the backside of said toilet and into said tank, said cable housing and said cable being held in position in said interior of said tank via said tank clamp, said cable exiting said cable housing within said interior of said tank and connecting to said internal release means within said tank to effect said flushing of said toilet by foot, whereby upon applying pressure by foot to said top plate of said pedal, a length of said cable is increased within said pedal and decreased by said length within said interior of said tank to activate said internal release means and effect flushing of said toilet.

21. The apparatus of claim 20 wherein said pedal is mounted to a floor adjacent a toilet.

22. The apparatus of claim 20 wherein said toilet is selected from the group consisting of a gravity tank toilet, a pressurized tank toilet, and a flush valve operated toilet.

23. The apparatus of claim 22 wherein said internal release means comprises a flapper or a pressurized tank push valve.

24. The apparatus of claim 20 further including at least one attachment device within said tank connecting said cable to said internal release means.

* * * * *